United States Patent [19]

Smith

[11] Patent Number: 4,480,970

[45] Date of Patent: Nov. 6, 1984

[54] SELF PRIMING GEAR PUMP

[75] Inventor: Stanley Smith, Gloucestershire, England

[73] Assignee: Rolls-Royce Limited, London, England

[21] Appl. No.: 383,191

[22] Filed: May 28, 1982

[30] Foreign Application Priority Data

May 30, 1981 [GB] United Kingdom ..... 8116599

[51] Int. Cl.[3] ..... F04C 2/18; F04C 15/00

[52] U.S. Cl. ..... 418/15; 418/180; 418/206

[58] Field of Search ..... 418/15, 180, 206, 102

[56] References Cited

U.S. PATENT DOCUMENTS

| | | | |
|---|---|---|---|
| 3,280,756 | 10/1966 | Gordon | 418/74 |
| 3,526,470 | 9/1970 | Swanson | 418/15 |
| 4,090,820 | 5/1978 | Teruyama | 418/102 |
| 4,097,206 | 6/1978 | Schonherr | 418/189 |

FOREIGN PATENT DOCUMENTS

| | | | |
|---|---|---|---|
| 489052 | 12/1952 | Canada . | |
| WO79/00141 | 3/1979 | PCT Int'l Appl. . | |
| 582712 | 11/1946 | United Kingdom | 418/15 |
| 2093529 | 8/1980 | United Kingdom . | |

*Primary Examiner*—John J. Vrablik
*Assistant Examiner*—T. Olds
*Attorney, Agent, or Firm*—Parkhurst & Oliff

[57] ABSTRACT

A self priming gear pump 14 for pumping liquids containing gases is provided with a vent pipe 26 for releasing entrapped gases that would otherwise collect at the outlet side of the pump 14. The vent pipe 26 terminates within the pump housing 21 at a zone which is out of the path of the oil centrifuged by the gears 25 and in the region lying near the point of intersection of the gears 25. An additional inlet pipe 27 which directs liquid across the main inlet into the gap between the periphery of one of the gears 25 and the housing 21 may be provided to improve liquid sealing.

3 Claims, 1 Drawing Figure

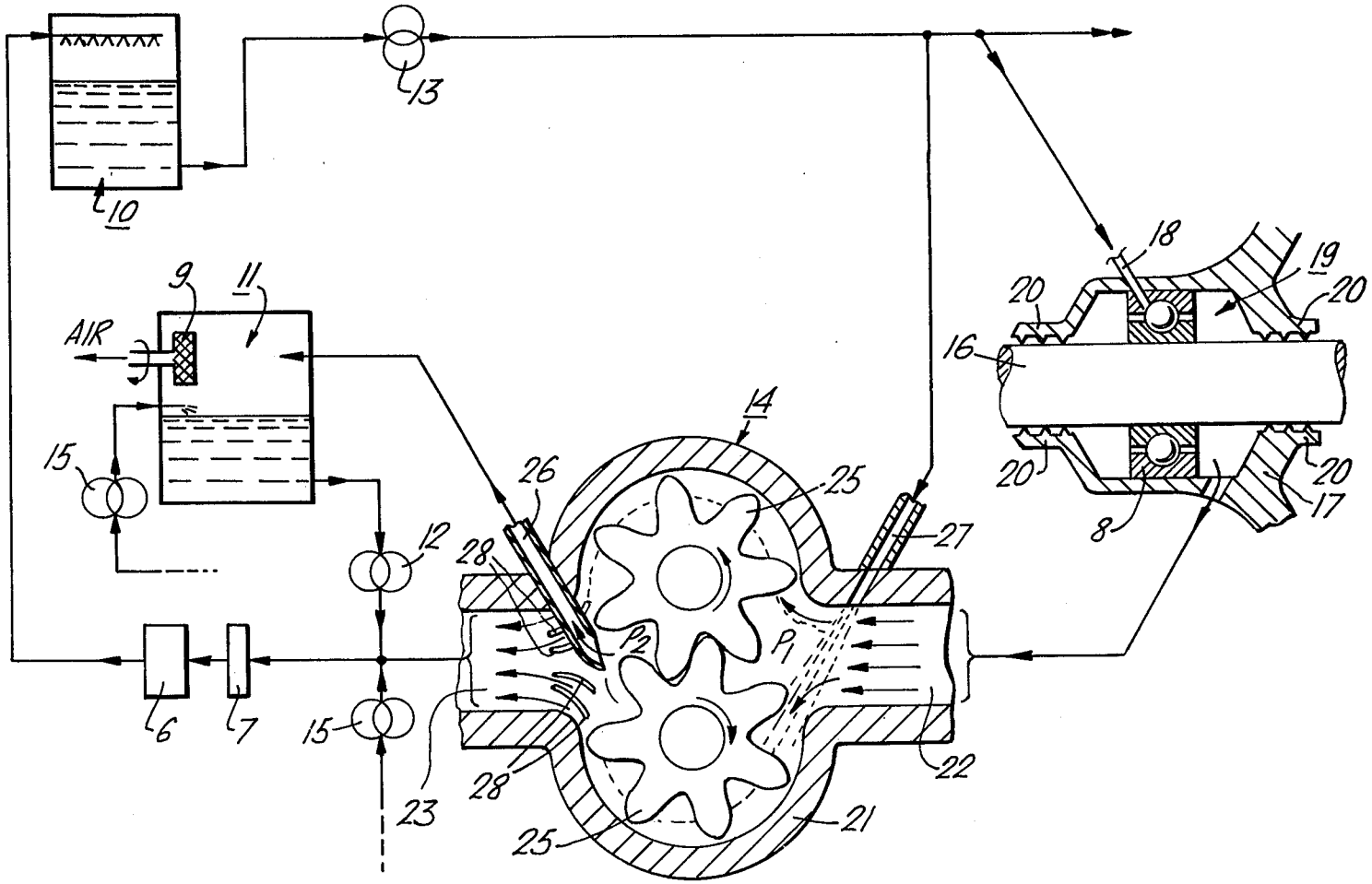
19
20
20
17
18
8
20
20
16
27
22
25
21
14
P1
P2
26
28
28
25
23
13
12
15
11
7
9
6
10
AIR
15

SELF PRIMING GEAR PUMP

This invention relates to self priming gear pumps; that is to say to pumps which employ intermeshing gears for pumping liquids, emulsions or mixtures of liquids and gases, with means for keeping the pump primed with liquid.

In some applications the gear pump can unintentionally entrain air or other gases with the liquid to be pumped. In other applications the gear pump is used to pump aerated liquids, liquids containing gases or emulsions of liquids and gases. We have found that in both of these applications the liquids are centrifuged to the perimeter of the gears and the gaseous phase becomes trapped in a void formed at the delivery side of the pump in the lee of the intermeshing gears. The entrapped gas becomes highly compressed and is forced through the intermeshing gears back to the inlet side of the pump at extremely high velocities. This highly compressed gas prevents the liquid from entering the pump and eventually the pump recirculates the trapped gases and fails to pump the liquid. The pump then requires to be re-primed with liquid before it will continue pumping.

It can be shown that any gear pump designed to pump liquids that contain gas will unprime (i.e. empty itself of the liquid) if it has to pump against a high pressure, and will not prime itself until the pressure at the inlet and outlet are nearly equalised.

In some applications, for example, a lubrication system of a gas turbine aero-engine, it is impossible to re-prime the gear pumps while the pumps are running, and even a momentary loss of supply of oil to vital parts of the engine could prove disastrous.

In general, the entrappment of gas limits the overall pressure ratio that the gear pump can cope with before the gear pump unprimes with liquid. Typical gear pumps as would be used for pumping aerated oil in a lubrication system of a gas turbine aero engine fail at pressure differentials between the inlet and outlet of the order of 5:1 to 10:1.

The invention as claimed overcomes the problem of the entrappment of air or gases which would otherwise cause the pump to fail, by providing a vent to release the air as it forms at the outlet side of the pump.

It has been found that a conventional gear pump designed to pump aerated oil which normally fails at pressure ratios of about 10:1, when modified in accordance with the present invention, can cope with pressure ratios in excess of 100:1, and can also be stopped and restarted without independently repriming the pump.

The invention will now be described, by way of an example, with reference to the accompanying drawing which shows, schematically, part of an oil lubrication system of a gas turbine aero engine incorporating a gear pump constructed in accordance with the present invention.

Referring to the drawing there is shown a pressurisable oil system which includes a tank 10, and a gearbox 11 which is driven from a shaft of the gas turbine aero-engine in a manner that is well known. The gearbox 11 is provided for driving various engine accessories including the four gear pumps 12, 13, 14, 15 and the centrifugal breather 9, which is constructed and operates as described in our co-pending British Pat. No. 1,508,212.

The gear pump 12 scavenges oil from the sump of the gearbox 11 and returns it under pressure to the tank 10. The gear pump 13 pumps oil from the oil tank and supplies it under pressure to various parts of the engine to be lubricated. In the drawing, one of the parts to be lubricated is a bearing 8 which supports a shaft 16 of the engine for rotation relative to fixed structure 17. The pressurised oil is supplied to the bearing 8 through appropriately placed oil ways 18 and the oil from within the bearing chamber 19, together with air that leaks into the chamber 19 through the labyrinth seals 20 is scavenged by the gear pump 14. Other gear pumps 15 scavenge oil from other parts of the engine and return it to the tank 10 and gearbox 11 via a filter 7 and cooler 6.

Only one gear pump 14 is shown as incorporating the present invention for the sake of clarity. It is to be understood that all the gear pumps may incorporate the present invention.

Referring in greater detail to the gear pump 14, the pump comprises a housing 21 having an inlet 22 connected to the drain of the bearing chamber 19 and an outlet 23 connected to the tank 10. The housing 21 accommodates two intermeshing gears 25 which have conventional gear tooth profiles and are mounted in bearings and driven by a shaft from the gearbox 11.

The housing 21 is also provided with a vent pipe 26 which is of 0.040 to 0.050" (1.0 to 1.5 mm) diameter connected to the air space in the gearbox 11. The end of vent pipe 26 is situated at the outlet side of the pump close to the nip of the intermeshing gears. That is to say at a region lying near the point of intersection of the gears out of the path of liquid centrifuged by the gears where, because of the centrifugal forces on the oil as it is propelled around the periphery of the gears, the air or gases is likely to build up.

Additionally the housing 21 is provided with a second inlet pipe 27 of about 0.80" (2.0 mm) diameter at the inlet side of the pump 14. The second inlet pipe 27 is angled relative to one of the gears 25 and relative to the flow of liquid/air mixtures through the main inlet of the pump. The inlet pipe 27 directs high pressure jets of oil from the high pressure gear pump 13 across the inlet into the gap between the outer periphery of the gear 25 and the housing to improve the oil seal, and also keep the pump primed with liquid.

In operation of the gear pump 14 oil is centrifuged to the wall of the housing and any entrapped air tends to build up in the zone ($P_2$) immediately out of the path of the centrifuged oil as it is propelled towards the outlet of the pump (that is to say at the region lying near the point of intersection of the gears 25). As the air builds up it is vented through the pipe 26 because the air space in the gearbox is maintained at a pressure lower than that of $P_2$ by means of the centrifugal air separator and breather 9 which is driven by the gearbox 11 and is constructed as described in our co-pending British Pat. No. 1,508,212. The vent pipe 26 is capable of removing air at a rate equivalent to the air contained in or associated with 200 gallons per hour of oil pumped by the gear pump.

The opposing streams of centrifuged oil collide and cause thorough mixing of any air not trapped in zone $P_2$, thereby producing an emulsion which is returned to the tank 10 and passed through an air separator. To lessen the task of separating air at the tank, guide cascade plates 28 could be added at the outlet of the gear pump. These plates serve to redirect the centrifuged oil and thereby minimise direct collision of opposing streams of oil.

Referring to the drawing, the present invention overcomes the problem of the gear pumps becoming unprimed when an aircraft executes maneuvers that starve the oil system of a sufficient supply of oil to keep the pumps filled. With oil systems like that shown schematically in the drawing, (where the gear pumps 14 and 15 discharge back to the tank through a common return, and the pumps are not vented according to this invention) air entrained by any of the pumps 14 or 15, or any drop in the gearbox pressure (for example at high altitude) will cause the pump 14 to pump the air back from its outlet to its inlet and back to the gearbox. This in turn prevents the pump 14 priming with oil. The present invention allows the air to pass back to the gearbox without allowing the pump 14 to imprime with oil.

I claim:

1. A gear pump comprising a housing having a first inlet opening communicating with a first liquid source and an outlet opening, two intermeshing gears which, when driven, pump liquid from the first inlet opening to the outlet opening, a vent pipe extending into the housing at the outlet side of the pump to a region spaced from the housing and lying near the point of intersection of the gears out of the path of liquid centrifuged by the gears, and a second inlet opening communicating with a second liquid source angled relative to the first inlet opening so as to direct liquid across the first inlet opening into a gap formed between the periphery of one of the gears and the housing.

2. A gear pump according to claim 1, further comprising pressure reducing means connected to the vent pipe which provides a source of pressure lower than that at the region where the vent pipe terminates within the housing to aid in venting accumulated gases within the gear pump.

3. A lubricating system for a bearing chamber of a machine, the system comprising:

a gear pump comprising a housing having a first inlet opening and an outlet opening, two intermeshing gears which, when driven, pump liquid from the first inlet opening to the outlet opening, a vent pipe extending into the housing at the outlet side of the pump to a region spaced from the housing and lying near the point of intersection of the gears out of the path of liquid centrifuged by the gears, and a second inlet opening angled relative to the first inlet opening so as to direct liquid across the first inlet opening into a gap formed between the periphery of one of the gears and the housing, said second inlet being fluidly connected to a source of pressurized liquid, a bearing chamber having an inlet and an outlet, the outlet of the bearing chamber being fluidly connected to the first inlet opening of the gear pump, storage means for receiving liquid scavenged from the bearing chamber and fluidly connected to the outlet opening of the pump, and said source of pressurized liquid supplying the inlet of the bearing chamber and the second inlet opening of the gear pump, the source of pressurized liquid being fluidly connected to the storage means.

* * * * *